US005421186A

United States Patent [19]

Lefavour

[11] Patent Number: 5,421,186

[45] Date of Patent: Jun. 6, 1995

[54] CRIMP DIE WITH POSITIVE CONNECTOR STOP

[75] Inventor: John Lefavour, Litchfield, N.H.

[73] Assignee: Burndy Corporation, New York, N.Y.

[21] Appl. No.: 47,844

[22] Filed: Apr. 15, 1993

[51] Int. Cl.[6] ..... H01R 43/042; B21D 11/22

[52] U.S. Cl. ..... 72/416; 72/410; 72/461

[58] Field of Search ..... 72/414–416, 72/410, 409, 453.15, 453.16, 470, 474, 475, 461; 29/751, 753

[56] References Cited

U.S. PATENT DOCUMENTS

| | | | |
|---|---|---|---|
| 1,677,968 | 7/1928 | Hughes | 29/753 |
| 2,869,407 | 1/1959 | Swanson | 72/453.16 |
| 3,406,558 | 10/1968 | Tillmann | 72/416 |
| 3,420,086 | 1/1969 | Long | 29/751 |

FOREIGN PATENT DOCUMENTS

| | | | |
|---|---|---|---|
| 951885 | 7/1974 | Canada | 29/753 |

*Primary Examiner*—Daniel C. Crane
*Attorney, Agent, or Firm*—Burtsell J. Kearns; Patrick J. Walsh

[57] ABSTRACT

Crimping dies for hydraulic compression tools for electrical connectors and the like in which one of the dies in a matching set is provided with means for engaging and stopping a connector workpiece in proper position for crimping in the die jaw.

1 Claim, 3 Drawing Sheets

CRIMP DIE WITH POSITIVE CONNECTOR STOP

BACKGROUND OF THE INVENTION

The present invention relates to crimp dies for hydraulic compression tools for affixing electrical connectors to conductor wires.

Hydraulic tools for crimping connectors such as Burndy corporation HYPRESS models Y35, Y35-2 and Y750 utilize crimping dies for mechanically securing a connector to a conductor wire. These tools include a diehead subassembly fitted to operating handles which develop substantial crimping force for making the connection.

When securing a connector such as a terminal connector to a conductor, it is necessary to accurately locate the connector in the crimping dies so that a secure connection is made.

SUMMARY OF THE INVENTION

The present invention is directed to crimping dies for hydraulic compression tools and more particularly to providing means for positioning a workpiece connector when forming a connection with a conductor. The invention provides a die stop in the vicinity of the die crimping groove for engaging a workpiece connector so as to precisely locate the crimping portion of the connector. In this way, the crimping dies produce a firm and permanent mechanical connection between connector and conductor.

In a preferred form of the invention, a hydraulic compression tool is provided with a set of crimping dies normally referred to as movable and stationary die members. A die stop is formed into the body of the stationary die a predetermined distance from the crimp groove of the die set. The die stop is also aligned with the crimp groove so as to engage and position the connector in correct position within the die crimp groove. In this way the operator is able to quickly and accurately form connections.

OBJECTS OF THE INVENTION

It is an object of the invention to provide a die stop for positioning workpiece connectors in crimping dies.

It is an object of the invention to provide a die stop formed integral with the stationary die of a die set for engaging a connector so as to properly position the connector in the crimping groove whereby a secure connection is made between connector and conductor.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention is shown in the accompanying drawing in which.

DETAILED DESCRIPTION OF THE INVENTION

Figure 1:
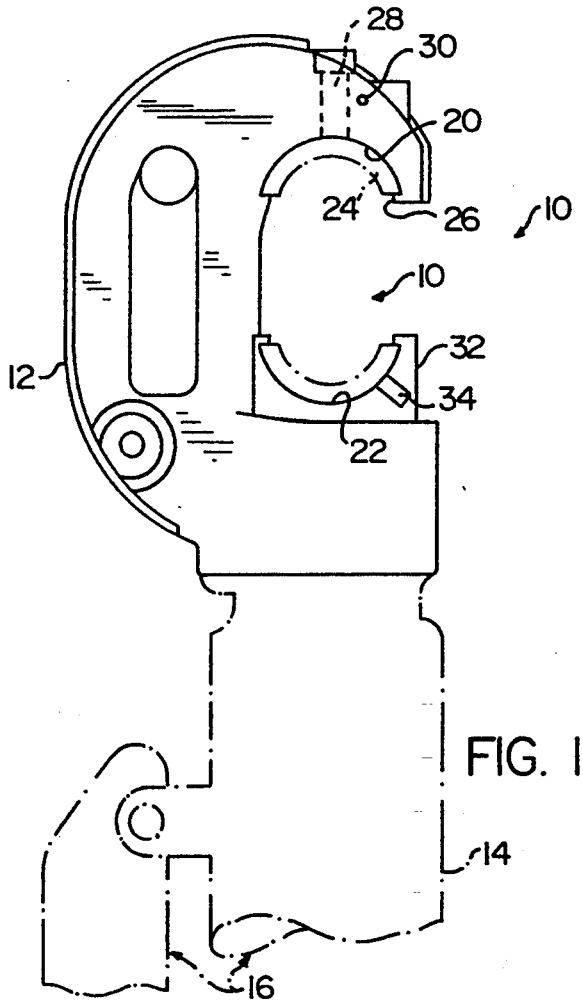
FIG. 1 is an elevational view of a hydraulic crimping tool according to the invention.

Referring now to the drawing and particularly to FIG. 1, the hydraulic crimping tool 10 according to the invention comprises several major components including a C-shaped die head 12, a pump housing 14, and operating handles 16.

The die head assembly includes a unitary C-shaped head 12 preferably forged integral defining a die cavity 18 between a fixed upper jaw 20 and a moveable lower jaw 22. The upper jaw is in the form of a crescent and receives a U-shaped die 24 supported by spaced ridges 26 and retained by a pin 28 and cooperating release shaft 30. The die 24 slips transversely into position in the upper jaw crescent. The lower jaw 22 is also in the form of a crescent at the upper surface of a piston ram 32 receiving a lower U-shaped die 24 between spaced supporting ridges and being retained by a lock pin 34. When using the hydraulic crimping tool, the upper and lower dies engage a connector workpiece 36 (FIG. 5) crimping it into place with substantial crimping force developed by the tool.

Figure 2:
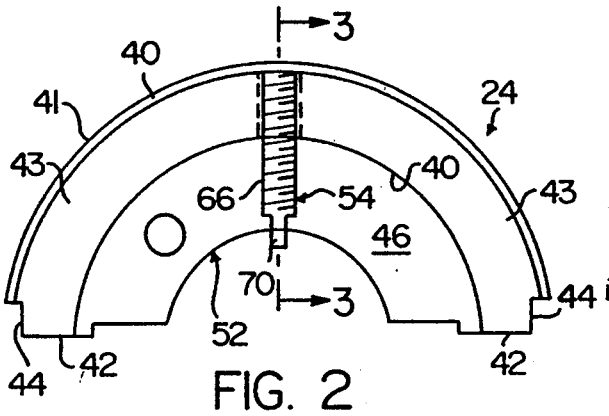
FIG. 2 is a front elevation of a preferred form of the invention, namely, a U-shaped die fitted with a die stop pin.
Figure 3:
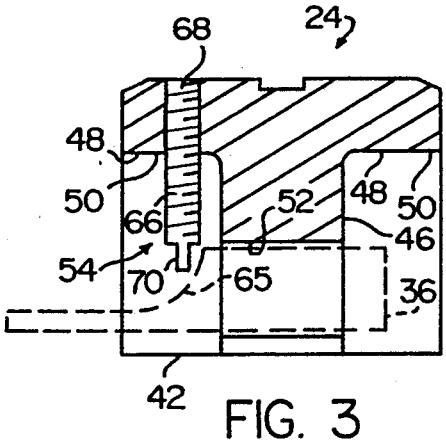
FIG. 3 is a section view taken along line 3—3 of FIG. 2.

The embodiment of the invention shown in FIGS. 2 and 3 comprises a die set of upper and lower dies 24. The upper die is stationary and is referred to herein as the stationary die whereas the lower die is moveable being affixed to the movable power ram. Both dies in the set are identical except for the placement of a die stop 54 on the stationary die. Accordingly, the specification proceeds with an illustration and description of the stationary member of the die set of each embodiment of the invention.

The stationary die 24 in FIGS. 2 and 3 is generally crescent or U-shaped and includes a curved spine 40 of generally rectangular cross-section terminating in spaced die faces 42 lying in a common plane. The outer margins of the spine are notched at 44 to define retaining edges by which the dies are retained in the C-shaped die head. The die further includes an integral die plate 46 extending across the inner face 48 of the spine. The die plate is centered along the inner face and occupies approximately one-third of the width of the inner face (as best shown in FIG. 2) thereby defining laterally extending shoulders 50 along the inner face on either side of the die plate. A crimp groove 52 is formed in the surface of the die plate of both the movable and stationary dies and represents the contact surface for engaging a connector workpice for crimping.

Figure 5:
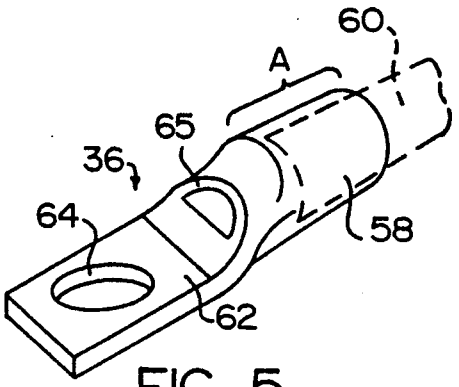
FIG. 5 is respective view of a connector which is positioned and crimped by a crimp die according to the invention.
Figure 4:
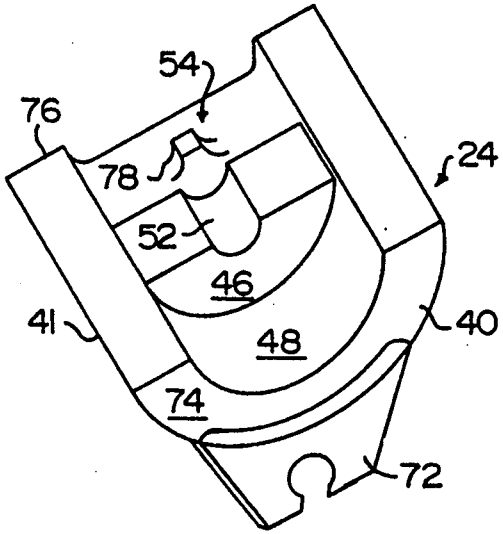
FIG. 4 is a perspective view of a modified embodiment of the invention, namely, a stationary die of a die set showing a die stop formed therein.
Figure 10:
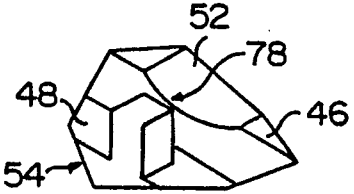
FIG. 10 is a frequency perspective view of the stop tab of the die of FIGS. 4, and 6–9.
Figure 9:
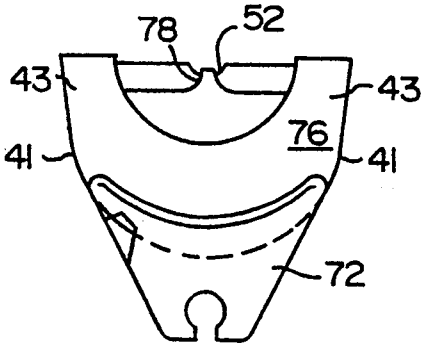
FIG. 9 is a rear elevation of the die of FIG. 4.
Figure 8:
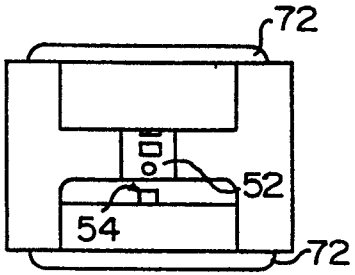
FIG. 8 is plan view of the die of FIG. 4.
Figure 11:
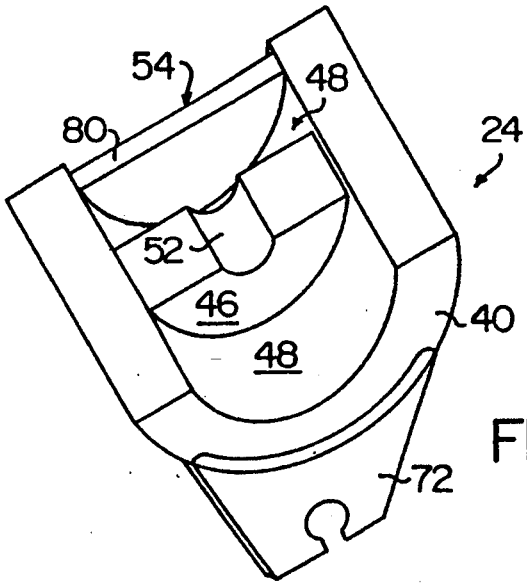
FIG. 11 is a perspective view of another modified embodiment of the invention, namely, a stationary die of a die set showing a die stop formed therein.
Figure 12:
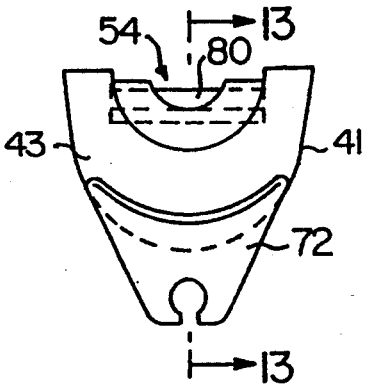
FIG. 12 is a front elevation of the die of FIG. 11.

In accordance with the invention, the die set includes means 54 for positioning a connector accurately in the crimp groove for crimp formation. A connector 36 is shown in FIG. 5 and includes a hollow sleeve 58 for receiving a conductor 60 and an integral plate 62 for connection to a terminal through a plate opening 64. An inclined shoulder 65 between the sleeve and plate provides a contact surface for positioning the connector in a crimping groove. The overlapping area A of contact between connector sleeve and conductor occurs over a limited portion of the connector. For example the area of contact A of a typical connector occurs in a one-half inch length of the connector sleeve. In order to achieve a proper mechanical joining of connector and conductor, it is necessary to position the crimp groove accurately on the connector sleeve. To accomplish this end, a die stop 54 is located on the inner face 48 of the stationary die to provide positive engagement and positioning of the connector sleeve in the crimp groove as shown in dash lines in FIG. 3. In a preferred form, the die stop 54 comprises a threaded cylinder 66 projecting from a matching threaded bore 68 through one of the lateral shoulders 50 of the die. The die stop terminates in a pin 70 extending longitudinally from the cylinder with the pin having a cylindrical outer surface. The pin may also have a polygonal cross-section defined by three or more flat outer surfaces for engagement by an adjusting tool for positioning the pin relative to the crimp groove. As shown in FIG. 3, the pin engages the inclined shoulder 65 of a connector so as to position the connector within the crimping dies such that the dies accurately crimp the connector sleeve forming a proper mechanical bond with the conductor. When the crimp is complete, the hydraulic force is released and the dies open to allow removal of the tool from the newly formed connection.

Figure 7:
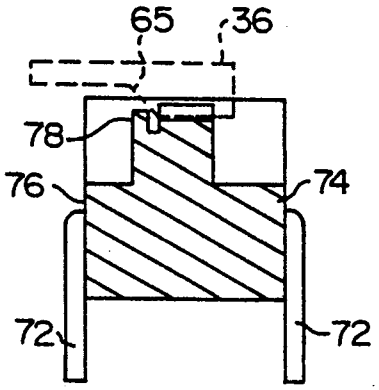
FIG. 7 is a section view taken along line 7—7 of FIG. 6.
Figure 6:
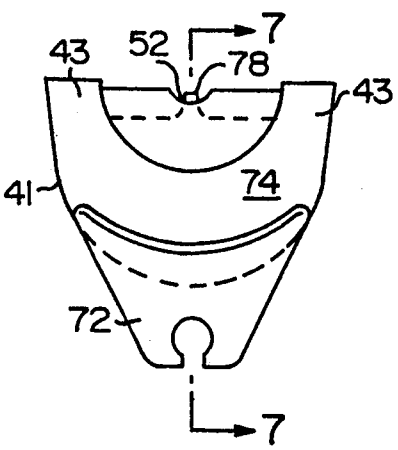
FIG. 6 is a front elevation of the die of FIG. 4.

A modified embodiment of the invention is shown in FIGS. 4, and 6–10 and comprises a die set with stationary die component illustrated and described. The die includes a main body or spine portion 40 with depending front and rear ears 72 for securing the die components to a hydraulic crimping tool. The central portion of the body or spine is recessed along inner face 48 to define a die plate 46 located across the recess and occupying approximately one-third of the width of the recess between the front 74 and rear 76 sides of the main body. A crimp groove 52 is formed in the die plate for receiving and crimping a connector sleeve in cooperation with a mating movable die having a similar crimp groove. In this embodiment of the invention, the means 54 for positioning the connector is in the form of a die stop tab 78. The stop tab is located adjacent the crimp groove for positioning a connector in the dies. The stop tab 78 has a box-like shape and is machined from the body stock by the formation of a recess on one side of the crimp groove with the tab projecting upward from the recess in axial alignment with the groove. The positioning of a connector 36 by the stop tab 78 is shown in FIG. 7.

Figure 13:
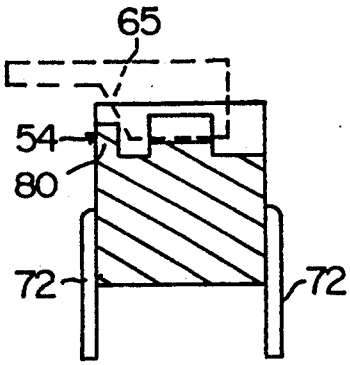
FIG. 13 is a section view taken along line 13—13 of FIG. 12.
Figure 14:
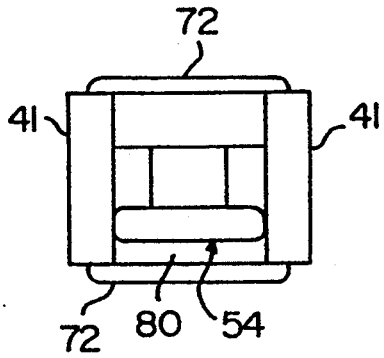
FIG. 14 is a plan view of the die of FIG. 11.
Figure 15:
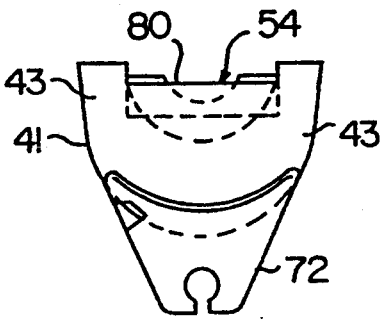
FIG. 15 is a rear elevation of the die of FIG. 11.

A further modification of the invention is shown in FIGS. 11–15 and comprises a stationary die 24 substantially similar to the stationary die of FIGS. 4, and 6–10. The die includes a main body or spine portion 40 with depending front and rear ears 72 for securing the die components to a hydraulic crimping tool. The central portion of the body is recessed along inner face 48 to define a die plate 46 located across the recess and occupying approximately one-third of the width of the recess between the sides of the main body. A crimp groove 52 is formed in the die plate for receiving and crimping a connector sleeve in cooperation with a mating movable die. In this form of the invention, the means 54 for positioning a connector is in the form of a die stop edge 80 formed in the recess 48 behind the die plate. The die stop edge extends across the die recess in parallel relationship to the die plate 46. The die stop edge engages the inclined shoulder 65 of a connector 36 as shown in FIG. 13 thereby positioning the connector sleeve accurately in the crimp groove.

For ease of reference in summarizing the invention, the matching dies 24 of each embodiment of the invention comprise the following components. Each die set includes a matched pair of stationary and movable dies 24 with each die having a body portion or spine 40. The body portion is defined by a U-shaped outer wall 41, substantially parallel front 74 and rear walls 76, a top wall including die faces 42, an arcuate recess or inner face 48 extending through the body portion and through the front and rear walls and thereby defining arcuate side walls 43 whose inner margins are the arcuate recess 48 and outer margins the U-shaped outer wall 41. A die plate 46 extends across the recess between the side walls with a crimping groove 52 in the die plate. The notches 44 of the embodiment of FIGS. 1–2, and the ears 72 of the embodiments of FIGS. 4, and 6–15 are for securing each die to a hydraulic compression tool with the die recesses in confronting relation and with the crimping grooves cooperating to engage and crimp a connector. Each embodiment of the invention is provided with means 54 forming part of one of the dies projecting from the arcuate recess 48 adjacent the crimping groove 52 of said one die for engaging and stopping a connector 36 in proper position for crimping by the tool. The engaging and stopping means include the stop pin 70 of FIGS. 1–2, the stop tab 78 of FIGS. 4, and 6–10, and the stop edge 80 of FIGS. 11–15.

In this way the invention promotes secure mechanical bonding between connector and conductor when the two are crimped with a hydraulic tool using a die set according to the invention.

I claim:

1. A die set for hydraulic compression tools for crimping connectors comprising a matched pair of stationary and movable dies with each die having a body portion, the body portion defined by a U-shaped outer wall, substantially parallel front and rear walls, a top wall having an arcuate recess extending through the body portion and through the front and rear walls and thereby defining arcuate side walls whose inner margins are the arcuate recess and outer margins the U-shaped outer wall, a die plate extending across the recess between the side walls, a crimping groove in the die plate, means for securing each die to a compression tool with the die recesses in confronting relation and with the crimping grooves cooperating to engage and crimp a connector, and a stop pin forming part of one of the dies projecting from the arcuate recess adjacent the crimping groove of said one die for engaging and stopping a connector in proper position for crimping by the tool, said stop pin being threaded into the recess surface and being adjustable with respect to the crimping groove of the said one die.

* * * * *